US006205610B1

(12) United States Patent
Westthorp

(10) Patent No.: US 6,205,610 B1
(45) Date of Patent: Mar. 27, 2001

(54) ADHESIVE TROWEL

(76) Inventor: Lee Anthony Westthorp, Unit 2, 1 Deacon Avenue, 5033, Richmond, State of South Austraila (AU)

( * ) Notice: Subject to any disclaimer, the term of this patent is extended or adjusted under 35 U.S.C. 154(b) by 0 days.

(21) Appl. No.: 09/445,111

(22) PCT Filed: Jun. 3, 1998

(86) PCT No.: PCT/AU98/00418

§ 371 Date: Dec. 2, 1999

§ 102(e) Date: Dec. 2, 1999

(87) PCT Pub. No.: WO98/55713

PCT Pub. Date: Dec. 10, 1998

(30) Foreign Application Priority Data

Jun. 4, 1997 (AU) ..... P07176

(51) Int. Cl.[7] ..... B05C 17/10

(52) U.S. Cl. ..... 15/235.4; 15/245.1; 15/236.08; 427/277; 427/355; 427/356; 427/369; 118/500

(58) Field of Search ..... 15/235.4, 235.6, 15/235.8, 245.1, 236.08; D8/45; D32/46; 427/286, 277, 355, 356, 369; 118/500

(56) References Cited

U.S. PATENT DOCUMENTS

D. 267,281 * 12/1982 Motti et al. ..... D32/46

5,231,729 * 8/1993 Rose ..... 15/235.4

FOREIGN PATENT DOCUMENTS

| | | |
|---|---|---|
| 2115287 | 11/1971 | (DE) . |
| 3543-146-A1 | 9/1987 | (DE) . |
| 2 259 938 | 3/1993 | (GB) . |

* cited by examiner

*Primary Examiner*—Brian K. Talbot
(74) *Attorney, Agent, or Firm*—Watts, Hoffmann, Fisher & Heinke Co LPA

(57) ABSTRACT

A tool (1) for spreading adhesive over a substrate has a blade edge (4) with a set of spaced large indentations (5) and at least one set of spaced smaller indentations (6) extending into the blade edge. The smaller indentations extend into the blade less than any one of the large indentations and are interspaced between the large indentations. The blade edge is slid over the substrate to which adhesive has been applied and the adhesive is spread such that the large indentations form large ridges (20) of adhesive projecting from the substrate. The smaller indentations form smaller ridges (21) of adhesive projecting from the substrate and the smaller ridges (21) are interspaced between the large ridges (20). When a tile (23) is pressed into the adhesive the larger ridges (20) are compressed first, thereby broadening the ridge and pushing adjacent ridges into the smaller ridges (21). In this any void between ridges is more readily filled and a more uniform spread of keyed in adhesive is achieved.

30 Claims, 3 Drawing Sheets

ADHESIVE TROWEL

This invention relates to a tool suitable for spreading adhesive upon a substrate. The tool in a preferred form can be a trowel suitable for manual application and spreading of adhesive across a substrate which is being tiled with ceramic tiles. This application will be used to explain the invention but it will be appreciated that the invention is not limited to this specific application.

BACKGROUND OF INVENTION

In the case of tiling, a tile is pressed onto a number of ridges of adhesive and the ridges are collapsed thereby forcing adhesive into the space between the ridges. During this process air which was within the space between the ridges should be expelled along the valleys and vented to the surrounding room or area. In this way the substrate should become covered with adhesive and likewise for the tile face pressed towards the substrate.

The process of tiling typically utilises a trowel with an edge characterised by regularly spaced rectilinear indentations. The interspacing, width and extent of the indentations depend upon the adhesive and tiles being worked. Further the indentations and interspacing typically have a castellated appearance. An example is illustrated in FIG. 4(*a*) of the accompanying drawings.

The prior known process of tiling has been found to be in practice not entirely satisfactory. It has been observed that under normal work practices some tiles may not be adequately adhered to a substrate surface and as a result the tiles may become loose or crack. Such a fault may not be found until after some months or years and may permit water to enter beneath the-tiles and lead to further problems. Consequently, often a loose or cracked tile can lead to a considerable problem which may be expensive to solve.

It is believed these problems may arise, at least partly, because in practice the substrate surface does not become uniformly covered with adhesive and as a consequence some parts of a tile are not adhered to the substrate. It is also believed that uppermost portions of adjacent ridges of adhesive spread out under the pressure of a tile being pressed to the substrate and contact and bridge the intervening space and may close the space between adjacent ridges of adhesive. Then the bridge of adhesive helps support the tile and resist the force pressing it into the adhesive and traps air underneath the tile.

As a result a void free of adhesive can be formed near the surface between adjacent ridges.

As will be appreciated, using a prior known trowel the adhesive is spread generally over and keyed into the substrate and then combed with the edge bearing the indentations thus forming ridges of adhesive. As the tile is pushed into place it is moved transverse to the ridges back and forth to collapse the ridges and expel the air from between the ridges of adhesive. With a large tile the surface area is significant and the required force to expel the air and collapse the ridges of adhesive is considerable and so proper setting of the tile may not be achieved.

OBJECT OF THE INVENTION

It is a proposed object of this invention to provide a tool to obviate or minimise at least one of the aforementioned problems, or at least provide the public with a useful choice.

BRIEF SUMMARY OF INVENTION

The tool described herein can be, in a preferred form, a trowel suitable for manual application and spreading of adhesive across a substrate which is being tiled with ceramic tiles. This application will be used to explain the invention but it will be appreciated that the invention is not limited to this specific application. Rather, once the invention is fully appreciated, it will understood that the invention is applicable to other applications where adhesive is spread in ridges across a substrate and an object is adhered to the substrate.

The invention may be said to reside, not necessarily in the broadest or only form, in a tool for spreading adhesive over a substrate, said tool including:

- a blade supported by support means and the blade being moveable over the substrate such that a blade edge is slid over the substrate;
- the blade edge having a set of spaced large indentations and at least one set of spaced smaller indentations extending into the blade edge, the smaller indentations extending into the blade less than any one of the large indentations and being interspaced between the large indentations so that in use large ridges of adhesive are formed interspaced with smaller ridges of adhesive.

From the above it will be appreciated that a trowel exhibiting the invention can have a blade with an edge having a first set of large indentations similar to prior known trowels that were previously mentioned. However, such a trowel can have a further set of smaller indentations in the interspace between the large indentations which extend into the blade less than the large indentations. As a result adhesive can be spread and formed into parallel ridges with adjacent ridges being of different heights.

In a preferred form the smaller indentations extend into the blade edge one tenth to one half the extent to which the large indentations extend into the blade edge. It will be appreciated that the ridges are sized to suit the particular application whilst also minimising the occurrence of voids proximal to the substrate.

In one preferred form, the large indentations are uniformly spaced along the blade edge and the smaller indentations are uniformly interspaced between the large indentations.

In another preferred form, the large indentations are of transverse widths greater than the transverse widths of the smaller indentations. In this form the ridges of adhesive made by using the tool not only differ in height but also in width.

In a preferred form the large and smaller indentations are rectilinear. In this case the ridges formed have substantially a rectilinear cross section. In another preferred form the large and smaller indentations have a curved portion at the innermost edge. This curved portion can be used to form ridges of adhesive with curved tops. This curved top can reduce the tendency of topmost portions of adjacent ridges to bridge and close the intervening space, thereby forming voids free of adhesive adjacent the substrate. Further, the use of a curved top increases the effective pressure applied to the ridge of adhesive since the force of pushing the tile, for example, is spread over a reduced area of ridge top compared with a flat topped ridge. Consequently the ridges collapse more readily.

According to one preferred form the support means includes a handle for manual manipulation of the tool. It will be appreciated that the invention need not be limited to a trowel used for tiling and that the invention may have more general application for spreading adhesive on substrates. Accordingly, the tool may be a substantially planar blade or the blade may be part of a machine and so not manually manipulated in use.

The invention may alternatively be said to reside, again not necessarily in the broadest or only form, in a method of spreading adhesive over a substrate including the steps of:

applying adhesive to the substrate; and, using a tool including:

a blade supported by support means and, with respect to the substrate, the blade being moveable over the substrate such that a blade edge is slid over the substrate;

the blade edge having a set of spaced large indentations and at least one set of spaced smaller indentations extending into the blade edge, the smaller indentations extending into the blade less than any one of the large indentations and being interspaced between the large indentations;

to spread adhesive over the substrate by sliding the blade edge over the substrate to form large ridges interspaced with smaller ridges of adhesive projecting from the substrate.

BRIEF DESCRIPTION OF THE DRAWINGS

To assist in the understanding of the invention preferred embodiments will now be described with reference to the accompanying drawings:

FIGS. 4*a*–4*e* illustrate prior art, first and second embodiment blade edges respectively;

FIGS. 5*a*–5*b* illustrate the effect of pressing a tile into the ridges of adhesive formed using a prior art trowel wherein FIG. 5*a* shows a tile resting atop the adhesive and FIG. 5*b* shows a tile pressed into the adhesive; and FIGS. 6*a*–6*b* illustrate the effect of pressing a tile into the ridges of adhesive formed using a trowel that is an embodiment of the present invention, wherein FIG. 6*a* shows a tile resting atop the adhesive and FIG. 6*b* shows a tile pressed into the adhesive.

It will be appreciated that the accompanying drawings are sketches illustrating the embodiments. Through out the drawings the same reference numeral is used to refer to the same feature.

Figure 1:
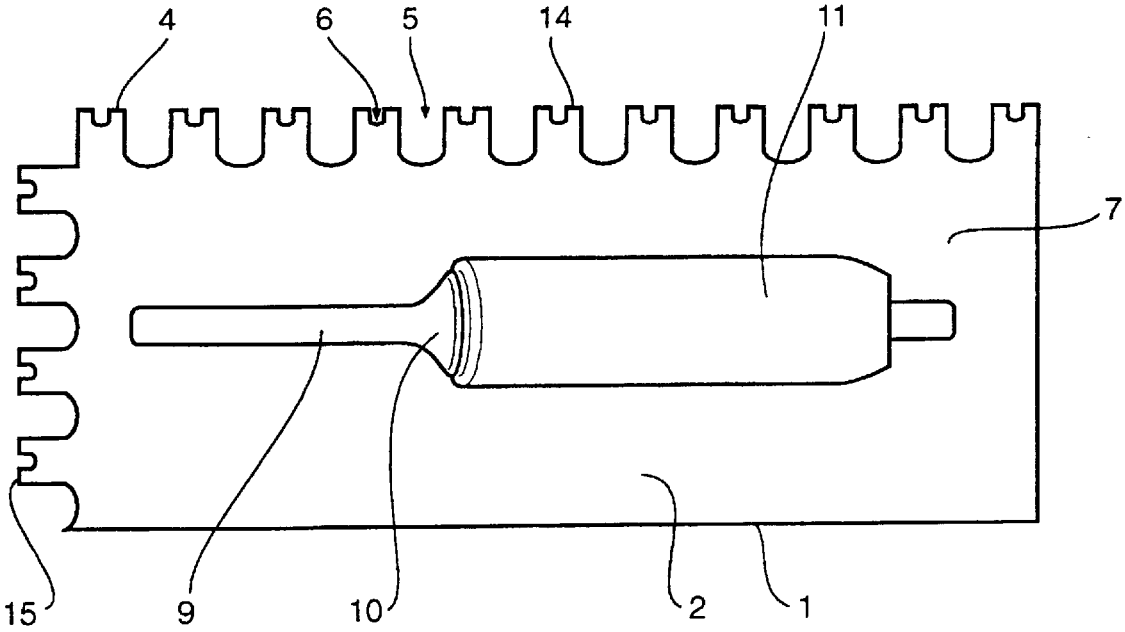
FIG. 1 is a plan view of a second embodiment of the invention.
Figure 2:
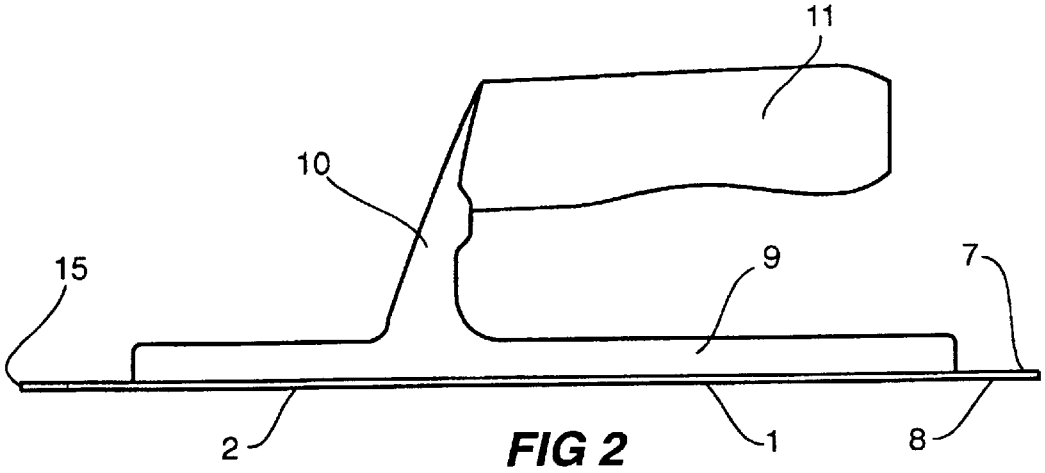
FIG. 2 is a side view of a second embodiment of the invention.
Figure 3:
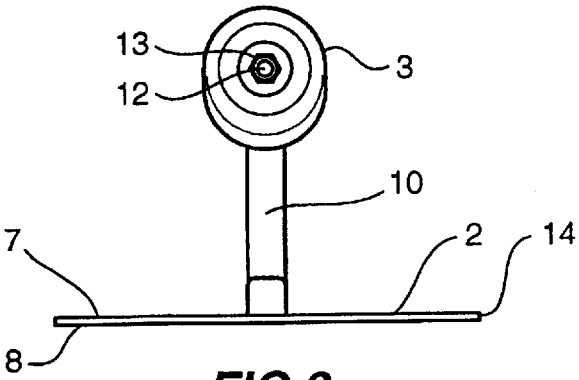
FIG. 3 is a rear view of a second embodiment of the invention.

Dimensions of certain of the parts as shown in the drawings may have been modified and/or exaggerated for the purposes of clarity of illustration and may be incomplete.

DETAILED DESCRIPTION

In broad terms, there is a tool (1) for spreading adhesive over a substrate. The tool, which could be a trowel, has a blade (2) which is supported by support means (3). The blade (2) is moveable over the substrate such that a blade edge (4) is slid over the substrate. It will be appreciated that the blade may be supported to move with respect to a substrate or alternatively the blade may be supported in a stationary position whilst the substrate is moved with respect to the blade.

The blade edge (4) can have a set of spaced large indentations (5) and at least one set of spaced smaller indentations (6) extending into the blade edge (4). The smaller indentations (6) extend into the blade (2) less than any one of the large indentations (5) and are interspaced between the large indentations (5). The relative extent of the indentations extending into the blade edge is selected to suit the particular application. Typically the smaller indentations extend into the blade one tenth to one half that of the large indentations. In one form this is approximately one third.

Figure 6A:
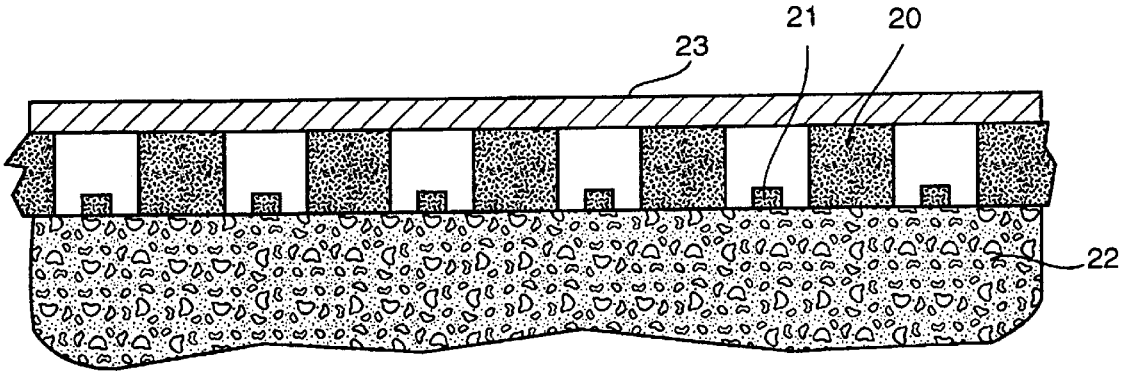
Figure 6B:
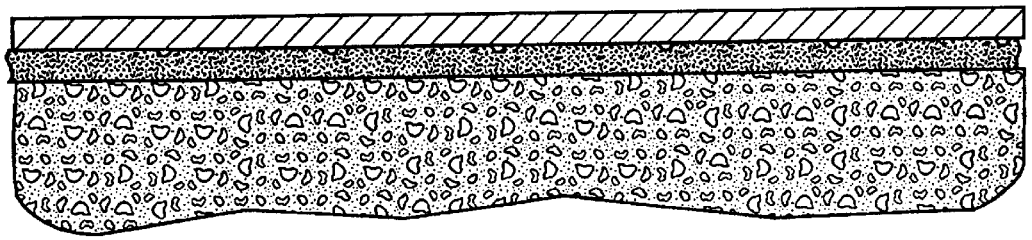

The tool (1) is adapted so that the blade edge (4) is slid over the substrate to which adhesive has been applied and the adhesive is spread such that the large indentations (5) form large ridges (20) of adhesive projecting from the substrate (22). The smaller indentations (6) form smaller ridges (21) of adhesive projecting from the substrate and the smaller ridges are interspaced between the large ridges (FIG. 6).

The first embodiment will now be discussed in more detail. The blade (2) is rectilinear with a top face (7) and a bottom face (8). The blade is pressed from steel plate approximately 1 mm thick and is approximately 280 mm long by 115 mm wide.

The support means (3) has a central web (9), stand (10), and handle (11). The stand, web and a bolt portion (12) are integrally formed form cast metal. The web strengthens the blade by increasing its rigidity and is welded to the blade. The stand projects upward from the blade so that the handle can be grasped with the fingers passing between handle and blade. The handle is made of wood and has a longitudinal hole permitting it to be threaded onto the bolt portion . In a recess within the handle a nut (13) is screwed onto the bolt portion so fixing the handle to the stand. It will be understood that the handle may also be manufactured from metal, plastic, wood or any suitable material. The handle and central web may be fixed to the blade by any means that will be obvious to a skilled person, which means may include gluing, welding, screwing or riveting.

Along the blade edge (4), in this case two edges (14 and 15) of the blade, are a set of regularly spaced large indentations (5) interspaced with a set of regularly spaced smaller indentations (6). The large indentations are approximately 12 mm wide and extend into the blade by approximately 12 mm. The interspacing between adjacent large indentations is approximately 12 mm. The smaller indentations are approximately 4 mm wide and extend into the blade approximately 4 mm. The smaller indentations are centrally spaced within the interspacing between adjacent large indentations. It will be understood that the dimensions of the indentations can be varied depending on the application or may be chosen from the list: 15 mm×15 mm (large indentations)/5 mm×5 mm (smaller indentations); 10 mm×10 mm (large indentations)/3.3 mm×3.3 mm (smaller indentations); 8 mm×8 mm (large indentations)/2.65 mm×2.65 mm (smaller indentations); 6 mm×6 mm (large indentations)/2 mm×2 mm (smaller indentations); 4 mm×4 mm (large indentations)1.3 mm×1.3 mm (smaller indentations).

As the blade edge (4), either edge (14 or 15) is slid over a substrate to which adhesive has been applied parallel ridges of adhesive (20,21) are formed as some of the adhesive is forced to pass through indentations (5 or 6). Adjacent ridges of adhesive will be of differing heights with every second ridge being of the same height. The larger ridges will be approximately 12 mm high whilst the smaller will be approximately 4 mm high.

When a tile (23) is pressed into the adhesive the larger ridges (20) are compressed first, thereby broadening the ridge and pushing adjacent ridges into the smaller ridges (21), as best illustrated in FIG. 6. In this way any void between ridges is more readily filled and a more uniform spread of keyed in adhesive is achieved.

It will be appreciated that not only is it desirable that a uniform spread of adhesive be achieved but also that the adhesive, when tiles are pressed into place, be approximately a predetermined thickness. These desired requirements mean that increasing the interspacing between indentations may reduce the likelihood of bridging of the topmost portions of adjacent ridges of adhesive and therefore reduce the likelihood of voids, but it may result in less than the desired thickness. Increasing the height of the ridges formed by increasing the extent that the indentations extend into the blade does not provide a solution. Likewise increasing the number of indentations but making them smaller does not provide a solution as suitable bedding of the tiles is not achieved.

The embodiment provides an improved solution to the problems whilst permitting substantially proper bedding in of the tiles.

Figure 4A:
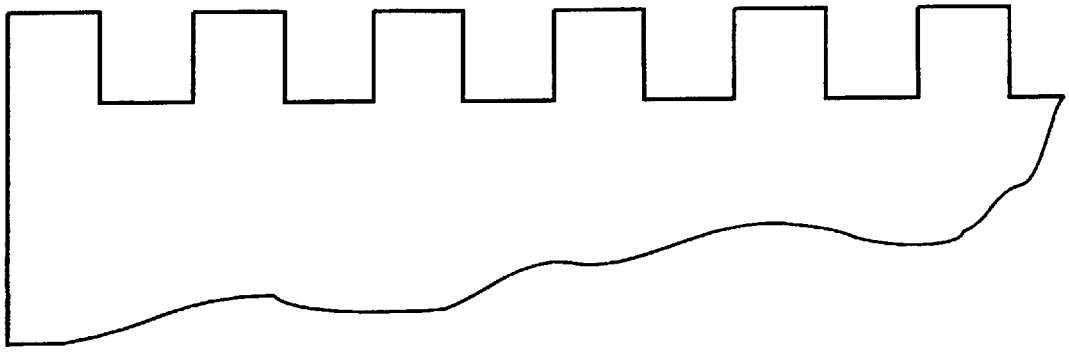
Figure 4B:
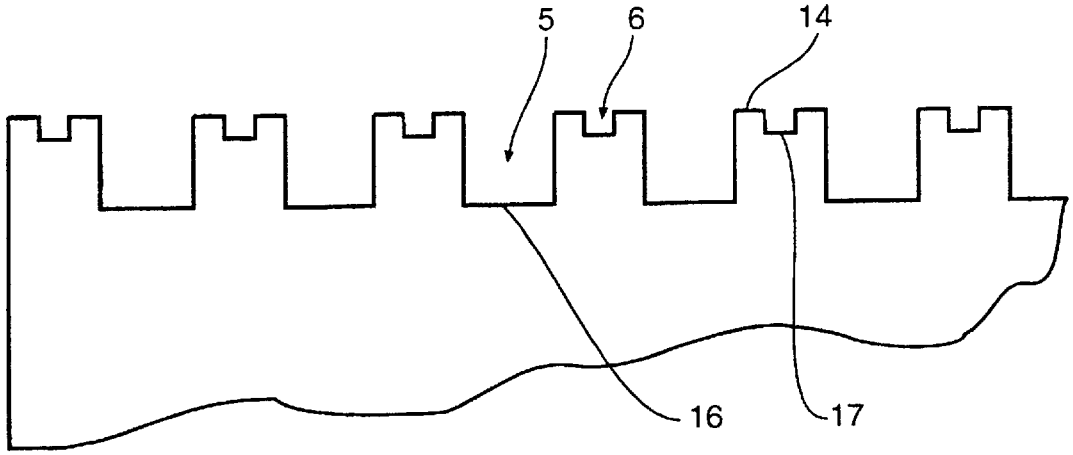

In FIG. 4(*a*) a prior art trowel edge is shown. The indentations are essentially 12 mm square so forming parallel ridges 12 mm high of adhesive. A similar view of that of FIG. 4(*a*) but for the first embodiment is given in FIG. 4(*b*). Here it will be noted that the innermost sides of the indentation (16 and 17) are substantially parallel to the edge (14). As previously mentioned the ridges formed are substantially square in cross section. In FIG. 4(*c*) the second embodiment is illustrated in terms of how it differs from the first embodiment, with other features the same as the first embodiment. Here the innermost edges (18 and 19) are curved so that the ridges formed have a curved top. This results in ridges with a curved top which reduces the tendency of topmost portions bridging as tiles are pressed into the adhesive.

It will be appreciated that this disclosure is not intended to limit the invention to preferred embodiments or details thereof. It is intended to give an overview of the invention. Other configurations of the large and smaller indentations are also contemplated by the invention including where there are multiple smaller indentations between adjacent large indentations. Likewise different indentation shapes are contemplated. These and other forms will be apparent to person skilled in the art and would fall within the spirit of the invention disclosed herein.

EXAMPLE

Comparative studies were undertaken to gauge the effect of adhesive coverage on tiles for the traditional towel as shown if FIG. 4(*a*) and the embodiment of the present invention as depicted in FIG. 4(*c*). The cement based adhesive used was ABA Super Tileset. The two trowels had blades of 280×115 mm. Four sets of cut window glass (300×300×3 mm) were used as substrate and as upper tile units for each trowel type.

The procedure for mixing and applying the adhesive was adopted from the European Norm draft document prEN 1348. The adhesive (2 kg) was mechanically mixed using slow speed settings, 140 rpm rotation and 62 rpm planetary movement for 2.5 minutes.

The adhesive was left in the bowl to cure for 5 minutes. Initially, a thin layer of adhesive was applied to the substrate glass with a straight edged trowel; immediately followed by a thicker combed layer by the testing trowels. The adhesive was applied for each substrate set over four continuous glass units, numbered 1 to 4. The trowel was held at a consistent angle of 60° to the substrate. After approximately 10 minutes the upper glass tiles were fixed onto the adhesive layer and loaded with a weight of 2.038 kg for 30 seconds; this exerts a force of 20 N.

After 48 hours drying, the lower substrate and upper tile contact areas were digitally photographed using a flat bed scanner at 300 dpi resolution. All photographs were then cropped to an area of 250×200 mm for analysis by computer image processing. The image processor was Image Tool version 1.27. After filtering, conversion of the images to greyscale, and appropriate thresholding to produce binary images, the percentage of coverage was calculated. The results are given in the following tables 1 through 3.

TABLE 1

Prior art trowel as in FIG. 4(a) (% coverage)

| Contact area | Tile 1 (%) | Tile 2 (%) | Tile 3 (%) | Tile 4 (%) | Mean Coverage (%) |
|---|---|---|---|---|---|
| Substrate (lower surface) | 88.43 | 78.70 | 73.25 | 62.14 | 75.63 |
| Tile (upper surface) | 91.58 | 81.43 | 74.53 | 59.46 | 76.75 |

TABLE 2

Figure 4C:
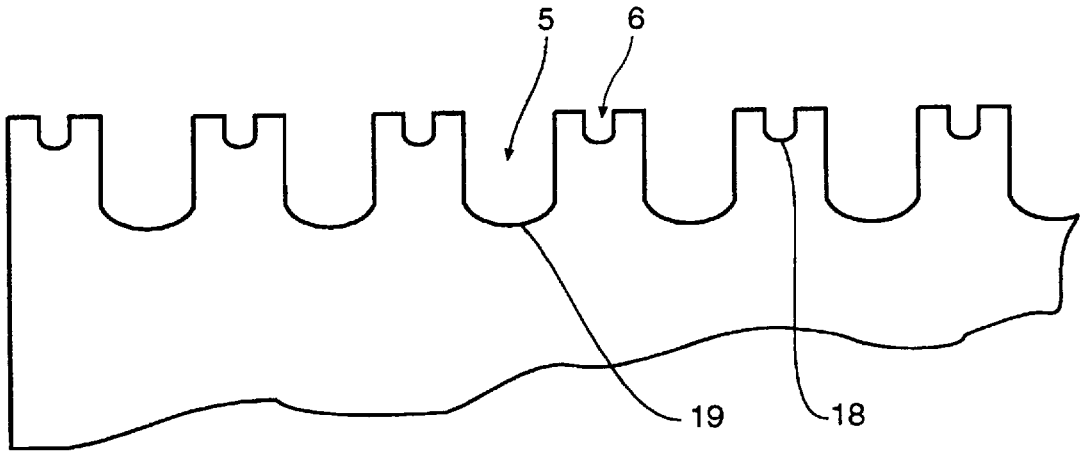
Figure 5A:
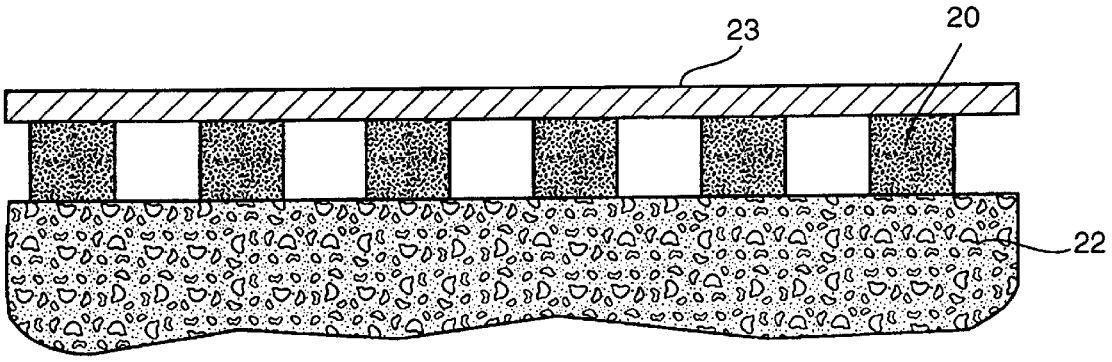
Figure 5B:
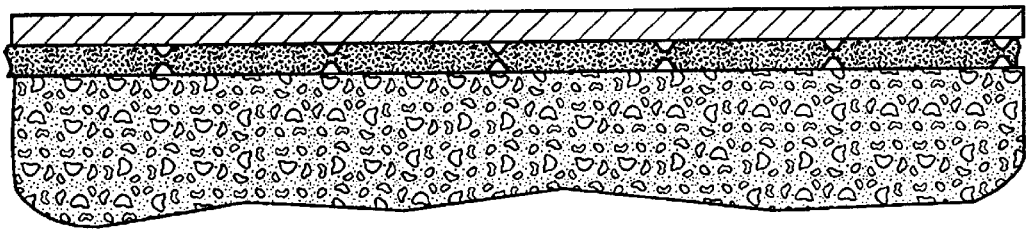

Trowel as in FIG. 4(c) (% coverage).

| Contact area | Tile 1 (%) | Tile 2 (%) | Tile 3 (%) | Tile 4 (%) | Mean Coverage (%) |
|---|---|---|---|---|---|
| Substrate (lower surface) | 87.72 | 91.58 | 84.47 | 75.15 | 84.73 |
| Tile (upper surface) | 91.38 | 93.68 | 88.80 | 74.55 | 87.10 |

TABLE 3

Mean difference (% coverage) for trowel as in FIG. 4(a) and trowel as in FIG. 4(c).

| Contact area | Tile 1 (%) | Tile 2 (%) | Tile 3 (%) | Tile 4 (%) | Mean Coverage (%) |
|---|---|---|---|---|---|
| Substrate (lower surface) | −0.71 | +12.88 | +11.22 | +13.01 | +9.10 |
| Tile (upper surface) | −0.20 | +12.25 | +14.27 | +15.09 | +10.35 |

These results indicate that the adhesive coverage for a trowel that is an embodiment of the present invention is approximately 10% greater than is achievable with the prior art trowel.

What is claimed is:

1. A tool for spreading adhesive over a substrate, said tool including:

a single blade supported by support means and the blade being moveable over the substrate such that a blade edge is slid over the substrate;

the blade edge having a set of spaced large indentations and at least one set of spaced smaller indentations extending into the blade edge, the smaller indentations extending into the blade less than any one of the large indentations and being interspaced between the large indentations so that in use large ridges of adhesive are formed interspaced with smaller ridges of adhesive so as to substantially reduce void formation when a tile is pushed into the adhesive.

2. A tool according to claim 1 wherein the large indentations are uniformly spaced along the blade edge and the smaller indentations are uniformly interspaced between the large indentations.

3. A tool according to claim 1 wherein the smaller indentations extend into the blade edge one tenth to one half the extent to which the large indentations extend into the blade edge.

4. A tool according to claim 1 wherein the large indentations are of transverse widths greater than the transverse widths of the smaller indentations.

5. A tool according to claim 4 wherein the large and smaller indentations are rectilinear.

6. A tool according to claim 4 wherein the large and smaller indentations contain a curved portion at an innermost edge.

7. A tool according to claim 1 wherein the tool is in the form of a trowel.

8. A tool according to claim 7 wherein the indentations are formed in two edges of the blade.

9. A tool according to claim 8 wherein the blade is rectilinear.

10. A tool according to claim 9 wherein the blade is pressed from steel plate.

11. A tool according to claim 10 wherein the support means includes a handle for manual manipulation of the tool.

12. A tool according to claim 11 wherein the support means has a central web, stand, and handle.

13. A tool according to claim 12 wherein the stand, web and a bolt portion are integrally formed form cast metal.

14. A tool according to claim 3 wherein the large indentations are approximately 12 mm wide and extend into the blade by approximately 12 mm and the interspacing between adjacent large indentations is approximately 12 mm.

15. A tool according to claim 14 wherein the smaller indentations are approximately 4 mm wide and extend into the blade approximately 4 mm.

16. A method of spreading adhesive over a substrate including the steps of:

applying adhesive to the substrate; and, using a tool including:

a single blade supported by support means and, with respect to the substrate, the blade being moveable over the substrate such that a blade edge is slid over the substrate;

the blade edge having a set of spaced large indentations and at least one set of spaced smaller indentations extending into the blade edge, the smaller indentations extending into the blade less than any one of the large indentations and being interspaced between the large indentations;

to spread adhesive over the substrate by sliding the blade edge over the substrate to form large ridges interspaced with smaller ridges of adhesive projecting from the substrate so as to substantially reduce void formation when a tile is pushed into the adhesive.

17. A method of spreading adhesive over a substrate according to claim 16 wherein the large indentations are uniformly spaced along the blade edge and the smaller indentations are uniformly interspaced between the large indentations.

18. A method of spreading adhesive over a substrate according to claim 17 wherein the smaller indentations extend into the blade edge one tenth to one half the extent to which the large indentations extend into the blade edge.

19. A method of spreading adhesive over a substrate according to one of claim 17 wherein the large indentations are of transverse widths greater than the transverse widths of the smaller indentations.

20. A method of spreading adhesive over a substrate according to claim 19 wherein the large and smaller indentations are rectilinear.

21. A method of spreading adhesive over a substrate according to claim 19 wherein the large and smaller indentations have a curved portion at an innermost edge.

22. A method of spreading adhesive over a substrate according to claim 16 wherein the tool is in the form of a trowel.

23. A method of spreading adhesive over a substrate according to claim 22 wherein the indentations are formed in two edges of the blade.

24. A method of spreading adhesive over a substrate according to claim 23 wherein the blade is rectilinear.

25. A method of spreading adhesive over a substrate according to claim 24 wherein the blade is pressed from steel plate.

26. A method of spreading adhesive over a substrate according to claim 25 wherein the support means includes a handle for manual manipulation of the tool.

27. A method of spreading adhesive over a substrate according to claim 26 wherein the support means has a central web, stand, and handle.

28. A method of spreading adhesive over a substrate according to claim 27 wherein the stand, web and a bolt portion are integrally formed form cast metal.

29. A method of spreading adhesive over a substrate according to claim 18 wherein the large indentations are approximately 12 mm wide and extend into the blade by approximately 12 mm and the interspacing between adjacent large indentations is approximately 12 mm.

30. A method of spreading adhesive over a substrate according to claim 29 wherein the smaller indentations are approximately 4 mm wide and extend into the blade approximately 4 mm.

* * * * *